United States Patent [19]

Hallsworth et al.

[11] Patent Number: 4,648,240

[45] Date of Patent: Mar. 10, 1987

[54] CONTINUOUS HIGH SPEED SPIN-DRAW-TEXTURING PROCESS FOR NYLON YARN

[75] Inventors: Rodney S. Hallsworth; Ralph C. Wirsig, both of Kingston, Canada

[73] Assignee: Du Pont Canada Inc., Mississauga, Canada

[21] Appl. No.: 813,203

[22] Filed: Dec. 24, 1985

[30] Foreign Application Priority Data

Dec. 28, 1984 [GB] United Kingdom ..... 8432736

[51] Int. Cl.[4] ..... D02G 1/02; D01D 5/16; D01D 5/22; D02J 1/22

[52] U.S. Cl. ..... 57/288; 28/245; 28/246; 57/287; 57/290; 264/168; 264/210.8; 264/290.7; 264/176.1; 425/66

[58] Field of Search ..... 57/284, 287, 288, 290, 57/339, 340; 264/103, 168, 176 F, 210.1, 210.8, 290.5, 290.7; 425/66, 72 S; 28/240, 245, 246

[56] References Cited

U.S. PATENT DOCUMENTS 3,719,442 3/1973 Schippers et al. ..... 264/168 X
4,081,948 4/1978 Parker ..... 57/288
4,103,480 8/1978 Rellensmann et al. ..... 57/288 X
4,149,366 4/1979 Bass et al. ..... 57/284 X
4,185,450 1/1980 Moruzzi et al. ..... 57/288 X

*Primary Examiner*—John Petrakes

[57] ABSTRACT

A continuous high speed spin-draw-false twist texturing process for producing a textured nylon yarn having high yarn uniformity is disclosed. The process comprises the steps of (a) melt-spinning a plurality of nylon filaments from nylon polymer; (b) cooling the filaments and combining them to form a yarn; (c) controlling the processing conditions of the nylon polymer of step (a) such that the relative viscosity of the yarn formed in step (b) is at least 45; (d) partially drawing the yarn at a draw ratio of from 2.3 to 3.5 and a temperature of at least 50° C.; (e) simultaneously false twist texturing and further drawing the partially drawn yarn in a draw-false twist texturing zone at a draw ratio of from 1.1 to 1.5; and (f) withdrawing the textured nylon yarn at a speed of at least 1500 meters per minute. The process is particularly useful for the manufacture of textured nylon yarn having a linear density in the range of from about 10 dtex to about 50 dtex.

17 Claims, 1 Drawing Figure

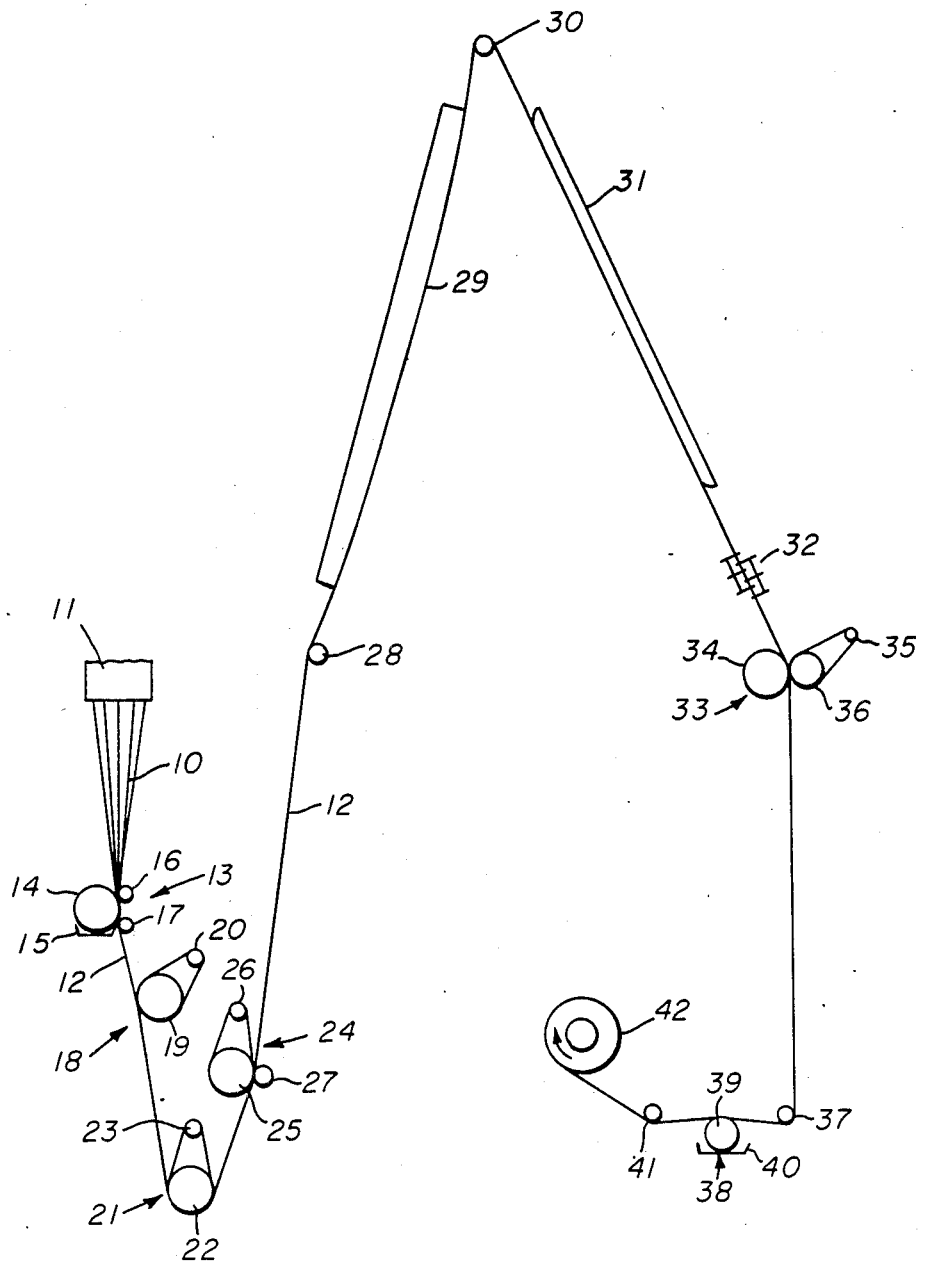
30
31
29
32
11
28
34
35
33
36
10
12
16
13
14
17
15
20
12
26
42
19
24
18
27
39
37
23
25
41
40
38
21
22

CONTINUOUS HIGH SPEED SPIN-DRAW-TEXTURING PROCESS FOR NYLON YARN

The present invention relates to a process for the manufacture of bulked nylon yarn which comprises melt spinning, drawing and bulking the yarn by false twist texturing, all in a continuous, integrated, spin-draw-texturing process. More particularly the invention relates to such a process in which the yarn passes from the false twist texturing step at a high rate of speed, for example, at least 1500 meters per minute.

Integrated spin-draw-texturing processes are known in the prior art. In some prior art processes, for example as described in U.S. Pat. No. 4,081,948, issued Apr. 04, 1978 to W. Parker, thermoplastic yarn filaments are combined, after leaving the spinneret of an extruder, to form a yarn and the yarn is draw-textured in a draw-false twist texturing zone. In other prior art processes, for example as described in U.S. Pat. No. Re. 29,959, reissued Apr. 10, 1979 to H. Schippers et al. (reissue of U.S. Pat. No. 3,719,442, issued March 06, 1973), thermoplastic yarn filaments are combined, after leaving the spinneret of an extruder, to form a yarn which is hot drawn in a hot drawing zone and then textured in a false twist texturing zone. Such prior art spin-draw-false twist texturing processes appear to be incapable of being operated so that the yarn passes from the false twist texturing zone at a speed of greater than about 1000 meters per minute.

Several prior art patents disclose false twist texturing processes said to be capable of operating with yarn exit speeds from the false twist texturing zone as high as 1500 meters per minute. For example, U.S. Pat. No. 4,103,480, issued Aug. 01, 1978 to W. Rollensmann et al. discloses false twist texturing speeds of from 400–1600 meters per minute and U.S. Pat. No. 4,149,366, issued Apr. 17, 1979 to D. Bass et al. discloses false twist texturing speeds of from 700–1500 meters per minute. None of the patents, however, gives any example of operation with a false twist texturing speed of greater than 1000 meters per minute. Moreover, such false twist texturing processes do not use a feed yarn which has been spun at the very low spinning speeds required for integrated spin-draw-texturing processes i.e. less than about 550 meters per minute. Yarns spun at such low spinning speeds have little orientation and may exhibit different characteristics during drawing and texturing operations than do commerical feed yarns.

False twist textured yarns produced in prior art integrated spin-draw-texturing processes may not have as good a "yarn uniformity" as is desired for certain end uses.

Yarn uniformity as used herein is measured by a so-called "FAK uniformity rating". FAK uniformity ratings may be obtained by knitting the yarn into a tube on a single-end circular FAK (fabric analysis knitting) machine. The knitted tubes are then dyed to a standard critical blue shade and stretched over paddle-shaped display boards for subjective analysis. Each board has a white side and a black side. The white side of the board emphasizes bulk variations, while the black side emphasizes dye depth variations. Each knitted tube is assigned a subjective score from 1 (worst) to 10 (best) based on its freedom from such defects as streaks, dark flashes, graininess, etc.

It has now been found that a false twist textured nylon yarn having high yarn uniformity may be produced at a speed of at least 1500 meters per minute in a continuous spin-draw-false twist texturing process provided that: (1) the yarn filaments are spun, from the spinneret of an extruder, from a nylon polymer under conditions such that the relative viscosity of the "as spun" yarn is at least 45; and (2) the nylon yarn filaments, after leaving the spinneret, are combined to form the yarn which is partially drawn in a drawing zone at a temperature of at least 50° C. and then draw-textured in a draw-false twist texturing zone, provided that the draw ratio in the draw-false twist texturing zone is in the range of from 1.1 to 1.5. Relative viscosity, as used herein is the ratio of viscosity (in centipoises) at 25° C. of a 8.4% by weight solution of nylon in 90% formic acid (90% by weight formic acid and 10% by weight water) to the viscosity (in centipoises) at 25° C. of the 90% formic acid alone.

Accordingly, the present invention provides a continuous spin-draw-false twist texturing process for producing a textured nylon yarn having high yarn uniformity, the process comprising the steps of:

(a) melt spinning a plurality of nylon filaments from nylon polymer;

(b) cooling the filaments and combining them to form a yarn;

(c) controlling the processing conditions of the nylon polymer of step (a) such that the relative viscosity of the yarn formed in step (b) is at least 45;

(d) partially drawing the yarn at a draw ratio of from 2.3 to 3.5 and at a temperature of at least 50° C.;

(e) simultaneously false twist texturing and further drawing the partially drawn yarn in a draw-false twist texturing zone at a draw ratio of from 1.1 to 1.5; and (f) withdrawing the textured nylon yarn at a speed of at least 1500 meters per minute.

In an embodiment of the process of the present invention, the processing conditions of the nylon polymer of step (a) are controlled such that the relative viscosity of the yarn formed in step (b) is in the range of from 45 to 75.

In another embodiment of the process of the present invention, the step of partially drawing the yarn is carried out by passing the undrawn yarn in a plurality of wraps around a heated feed roll and from the feed roll to a draw roll which is operating at a higher peripheral speed than the peripheral speed of the feed roll, the feed roll being operated at a temperature in the range of from 50° C. to 75° C.

In other embodiments of the process of the present invention, the textured yarn is withdrawn at speeds in the ranges of from 1500 to 2400 meters per minute or of from 1500 to 2200 meters per minute.

In yet another embodiment of the process of the present invention, a tension in the range of from 0.4 to 0.8 dN/tex is imparted to the undrawn yarn before it is passed around the heated feed roll.

In an additional embodiment of the process of the present invention the yarn is partially drawn at a draw ratio of from 2.5 to 3.4 and the draw ratio in the draw-false twist texturing zone is in the range of from 1.15 to 1.3.

In a further embodiment of the process of the present invention, the processing conditions of the nylon polymer of step (a) are controlled such that the relative viscosity of the yarn formed in step (b) is in the range of from 50 to 75.

In still further embodiments of the process of the present invention, the nylon polymer is selected from nylon 6,6 polymer, nylon 6 polymer and nylon 66/6 copolymer.

An embodiment of the present invention will be described in greater detail with the aid of the accompanying drawing which is a schematic representation of apparatus suitable for carrying out the process of the present invention.

In the drawing, a bundle of nylon filaments 10 emerging from the spinneret 11 of a polymer extrusion system (not shown) are cooled in conventional quenching facilities (not shown) and are formed into a yarn 12 at a spin finish application assembly 13. The latter comprises an applicator roll 14, a pan 15 containing spin finish and guides 16 and 17. It is important that the processing conditions of the nylon polymer from which the filaments are extruded be controlled such that the relative viscosity of the "as spun" yarn 12 is at least 45. It will be appreciated that a number of factors influence the relative viscosity of the "as spun" yarn, e.g. polymer chemical composition, temperature, moisture content, additives and residence time of the polymer melt. One convenient method commonly used to control the relative viscosity of nylon 6, 6 "as spun" yarn is to adjust the moisture content of the polymer by varying process settings.

Preferably the relative viscosity of the "as spun" yarn 12 is in the range of from 45 to 75 and more preferably in the range of from 50 to 75. If the relative viscosity of the yarn is substantially less than 45, the yarn is unsatisfactory for high speed false twist texturing in that, for example, there may be a large number of broken filaments. Operation of the process of the present invention at yarn relative viscosities above about 75 may require modifications to the process equipment, for example, a longer yarn heater may be required in the draw-false twist texturing zone.

The yarn 12 is pulled from the spin finish application assembly 13 by roll assembly 18, comprising a forwarding roll 19 and a separator roll 20. The yarn 12 is passed about forwarding roll 19 and separator roll 20 for a plurality of wraps. From the roll assembly 18 the yarn 12 passes to a heated feed roll assembly 21, comprising a heated feed roll 22 and a separator roll 23. The yarn 12 is passed about heated feed roll 22 and separator roll 23 for a plurality of wraps, preferably in the range of from 2 to 4 wraps. Heated feed roll assembly 21 preferably operates at a slightly higher (preferably 1 to 3% higher) peripheral speed than roll assembly 18 in order to impart a tension, in the range of from 0.4 to 0.8 dN/tex, in the yarn 12 before it is passed around the heated feed roll 22. Heated feed roll 22 is operated with a surface temperature in the range of from 50° to 75° C.

From the heated feed roll assembly 21, the heated yarn 12 passes to draw roll assembly 24, comprising a draw roll 25, a separator roll 26 and a nip roll 27. The yarn 12 is passed about draw roll 25 and separator roll 26 for a plurality of wraps preferably in the range of from 3 to 5 wraps. Draw roll assembly 24 runs at a faster peripheral speed than feed roll assembly 21 to partially draw the yarn 12 at a draw ratio in the range of from 2.3 to 3.5 and preferably in the range of from 2.5 to 3.4. It is important that the heated draw roll 22 be operated at a temperature of at least 50° C., preferably in the range of from 50° C. to 75° C., in order to fix the draw point. If the temperature of the hot roll 22 is less than 50° C., the draw point tends not to remain fixed and the yarn produced tends to lack uniformity. If the temperature of the hot roll is above about 75° C., excessive yarn growth tends to occur on the hot roll which leads to yarn slippage or to yarn breakdown. It will be appreciated that means other than a heated draw roll, for example, a heated shoe, may be used to fix the draw point. However, it is important that the temperature of such other means be such that the yarn is heated to a temperature of at least 50° C.

From draw roll assembly 24 the yarn 12 passes to a draw-texturing zone comprising a heater plate 29, a cooling plate 31, a friction twisting element 32, a draw roll assembly 33 (comprising a driven roll 34, a separator roll 35 and a nip roll 36), and yarn guides 28 and 30. The yarn 12 is passed about nip roll 36 and separator roll 35 for a plurality of wraps. The nip point between roll 34 and roll 36 prevents slippage of the yarn wraps caused by the difference between the relatively high tension in the yarn 12 before the draw roll assembly 33 and the relatively low tension in the yarn 12 after draw roll assembly 33. On leaving draw roll assembly 24 the partially drawn yarn 12 enters a section of increasing twist gradient due to the insertion of twist into the yarn by friction twisting element 32. Draw roll assembly 33 operates at a higher peripheral speed than draw roll assembly 24 to draw the partially drawn yarn 12 (on heater plate 29) at a draw ratio in the range of from 1.1 to 1.5 and preferably in the range of from 1.15 to 1.3. Preferably draw roll assembly 33 operates at a peripheral speed of at least 1500 meters per minute, especially in the range of from 1500 to 2400 meters per minute and more especially in the range of from 1500 to 2200 meters per minute. Preferably the heater plate 29 operates at a surface temperature in the range of 180° to 270° C., more preferably in the range of 205° to 245° C. From draw roll assembly 33, the draw-textured yarn 12 is passed through an oil application device 38, comprising an applicator roll 39, a pan 40 containing oil and guides 37 and 41 and then is wound up on package 42.

Nylon polymers, which are suitable for use in the process of the present invention, include, for example, polymers of nylon 6,6, nylon 6 and mixtures thereof.

The process of the present invention is especially useful for the manufacture of textured yarns having a linear density in the range of from 10–50 dtex at texturing speeds in the range of from 1500 to 2200 meters per minute. At such a linear density range, texturing speeds as high as 2400 meters per minute may be obtained. The process may also be used successfully, however, for manufacturing textured yarns having linear densities of 100 dtex or higher at texturing speeds of at least 1500 meters per minute.

The present invention is illustrated by the following examples:

EXAMPLE I

A bundle of 7 filaments of nylon 6,6 were extruded from the spinneret of an extruder, formed into a yarn, partially hot drawn in a drawing zone, false twist textured and further drawn in a draw-false twist texturing zone and wound up on a package as an approximately 22 dtex, 7 filament, false twist textured yarn. The apparatus used to carry out the above steps was as shown in the drawing and described hereinbefore. Additional details regarding the apparatus were as follows (see the drawing):

(a) heater plate 29 was a contact heater 3.0 meters in length: and (b) friction twisting element 32 was a disc type friction twister having diamond-coated working discs and chrome-plated guide discs. The numbers and placement of working and guide discs depend on several variables including surface characteristics, process speed and desired twist level.

Five runs were carried out. In run 1, the processing conditions of the nylon 6,6 polymer were controlled such that the relative viscosity of the as spun yarn was about 46.1. Roll assembly 18 was operated at a peripheral speed of 497 meters/minute and heated feed roll assembly 21 was operated at a peripheral speed that was approximately 2% faster i.e. at 507 meters/ minute, to impart a tension of about 0.5 dN/tex in the yarn being fed to heated feed roll 22. The yarn was passed around heated feed roll 22 and separator roll 23 for 5 wraps. Heated feed roll 22 was operated at a temperature of 67° C. Draw roll assembly 24 was operated at a peripheral speed of 1333 meters/minute to partially draw the yarn at a draw ratio of 1333/507=2.63.

In the draw-texturing zone, heater plate 29 was 3.0 meters in length and was operated at a temperature 225° C.; and friction twisting element 32 was a disc type friction twister which operated at 28,946 revolutions/-minute. Draw roll assembly 33 was operated at a peripheral speed of 1800 meters/minute to draw the partially drawn yarn on the heater plate 29 at a draw ratio of 1800/1333=1.35. The overall draw ratio (in the hot drawing zone plus the draw-texturing zone) was 1800/507=3.55. The textured yarn was wound up on package 42.

There were no broken filaments detected in the textured yarn during Run 1 and the FAK uniformity rating of the textured yarn, obtained by the method as described hereinbefore, was 7½.

Runs 2 to 5 were carried out similarily to Run 1. Operating conditions and results for Runs 1 to 5 are tabulated below in Table 1.

TABLE 1

| | Run Number | | | | |
|---|---|---|---|---|---|
| | 1 | 2 | 3 | 4 | 5 |
| Relative viscosity of the as-spun yarn | 46.1 | 51.9 | 62.7 | 63.0 | 67.2 |
| Peripheral speed of roll assembly 18 (meters/minute) | 497 | 427 | 503 | 542 | 652 |
| Peripheral speed of heated feed roll assembly 21(meters/ minute) | 507 | 436 | 513 | 553 | 667 |
| Number of wraps around feed roll 22 and seperator roll 23 | 5 | 5 | 3 | 3 | 3 |
| Temperature of heated feed roll 22(°C.) | 67 | 67 | 70 | 70 | 70 |
| Peripheral speed of draw roll assembly 24 (meters/minute) | 1333 | 1222 | 1538 | 1615 | 1692 |
| Draw ratio of partially drawn yarn | 2.63 | 2.80 | 3.00 | 2.92 | 2.54 |
| Temperature of heater plate 29(°C.) | 225 | 225 | 230 | 225 | 230 |
| Speed of friction twisting element 32 (revolutions/minute) | 28946 | 24285 | 31533 | 32062 | 34583 |
| Peripheral speed of draw roll assembly 33 (meters/minute) | 1800 | 1650 | 2000 | 2100 | 2200 |
| Draw ratio in the draw texturing zone | 1.25 | 1.35 | 1.30 | 1.30 | 1.30 |
| Overall draw ratio | 3.55 | 3.78 | 3.90 | 3.80 | 3.30 |
| Broken filaments detected during run | NIL | NIL | —* | —* | —* |

TABLE 1-continued

| | Run Number | | | | |
|---|---|---|---|---|---|
| | 1 | 2 | 3 | 4 | 5 |
| FAK Uniformity Rating of textured yarn | 7½ | 8 | 8½ —9 | 8½ | 8½ |

*not measured

EXAMPLE II

In order to determine the effect of varying the relative viscosity level of the "as spun" yarn, seven runs, Runs 6–12, were carried out similar to run 1 of Example I but each with a different relative viscosity level in the "as spun" yarn. The apparatus used was shown in the drawing and described in Example I. In each run the yarn wound up on the package was an approximately 22 dtex, 7 filament, false twist textured nylon 6,6 yarn. In run 6, the processing conditions of the nylon 6,6 polymer were controlled such that the relative viscosity of the as spun yarn was 59. Roll assembly 18 was operated at a peripheral speed of 373 meters/minute and heated feed roll assembly 21 was operated at a peripheral speed that was approximately 2% faster i.e. at 380 meters/minute, to impart a tension of about 0.5 dN/tex in the yarn being fed to heated feed roll 22. The yarn was passed around heated feed roll 22 and separator roll 23 for 3 wraps. Heated feed roll 22 was operated at a temperature of 67° C. Draw roll assembly 24 was operated at a peripheral speed of 1111 meters/minute to partially draw the yarn at a draw ratio of 1111/380=2.92.

In the draw-texturing zone, heater plate 29 was 3.0 meters in length and was operated at a temperature 225° C.; and friction twisting element 32 was a disc type friction twister which operated at 21,716 revolutions/-minute. Draw roll assembly 33 was operated at a peripheral speed of 1500 meters/minute to draw the partially drawn yarn on the heater plate 29 at a draw ratio of 1500/1111=1.35. The overall draw ratio (in the hot drawing zone plus the draw-texturing zone) was 1500/380=3.95. The textured yarn was wound up on package 42.

In each of runs 7–12 an attempt was made to keep all operating conditions the same as for run 6 except for the relative viscosity of the as spun yarn. However, as the relative viscosity of the as spun yarn decreased, it was necessary to increase the overall draw ratio in order to maintain adequate yarn tension in the draw-texturing zone.

The number of broken filaments per hour was recorded for each run. The relative viscosity of the "as spun" yarn, the overall draw ratio and the broken filament level in the textured yarn for each of runs 6 to 12 are tabulated below in Table 2.

TABLE 2

| Run No. | Relative Viscosity of "As Spun" Yarn | Overall Draw Ratio | Broken Filaments Per Hour |
|---|---|---|---|
| 6 | 59 | 3.95 | 1.03 |
| 7 | 55 | 3.95 | 2.26 |
| 8 | 52 | 4.00 | 5.5 |
| 9 | 50 | 4.10 | 0.92 |
| 10 | 47 | 4.15 | 2.5 |
| 11 | 43 | 4.20 | 36.5 |
| 12 | 35 | 4.40 | 44.0 |

It may be observed from TABLE 2 that the number of broken filaments per hour in the textured yarn increases markedly when the relative viscosity of the "as spun" yarn is below about 45 (Runs 11 and 12 which are outside the scope of the present invention).

EXAMPLE III

In order to determine the effect of varying the temperature at which the yarn is partially drawn, five runs, Runs 13–17, were carried out similar to run 1 of Example I, but each with a different surface temperature on the heated feed roll. The apparatus used was as shown in the drawing and described in Example I. In each run, the yarn wound up on the package was an approximately 22 dtex, 7 filament, false twist textured nylon 6,6 yarn. In each run, the following conditions were somewhat different than the conditions for run 1 of Example I.

Roll assembly 18 was operated at a peripheral speed of 367 meters/minute and heated feed roll assembly 21 was operated at a peripheral speed that was approximately 2% faster i.e. at 375 meters/minute, to impart a tension of about 0.5 dN/tex in the yarn being fed to heated feed roll 22. The yarn was passed around heated feed roll 22 and separator roll 23 for three wraps. Draw roll assembly 24 was operated at a pheripheral speed of 1111 meters/minute to partially draw the yarn at a draw ratio of 1111/375=2.96.

In the draw-texturing zone, heater plate 29 was operated at a temperature 225° C.; and friction twisting element 32 was operated at 21,967 revolutions/minute. Draw roll assembly 33 was operated at a peripheral speed of 1500 meters/minute to draw the partially draw yarn on the heater plate 29 at a draw ratio of 1500/1111=1.35. The overall draw ratio (in the hot drawing zone plus the draw-texturing zone) was 1500/375=4.0. The textured yarn was wound up on package 42.

In order to obtain an indication of the yarn uniformity for the yarn produced in each run, FAK uniformity ratings were obtained by the method described hereinbefore. The surface temperature of the heated feed roll and the FAK uniformity rating for each of runs 13 to 17 are tabulated below in TABLE 3.

TABLE 3

| Run No. | Surface Temperature of Heated Feed Roll (°C.) | FAK Uniformity Rating |
|---|---|---|
| 13 | 40 | 3 |
| 14 | 51 | 7–7 ½ |
| 15 | 60 | 7 |
| 16 | 66 | 8–8 ½ |
| 17 | 72 | 8–8 ½ |

It may be observed from TABLE 3 that textured yarn with a good yarn uniformity rating is produced when the surface temperature of the heated feed roll is above about 50° C. (Runs 14 to 17). Run 13 outside the scope of the present invention and is included for comparative purposes only.

EXAMPLE IV

In order to determine the effect of replacing heated roll 22 (see FIG. 1) with a so-called "hot shoe", two runs, Runs 18 and 19, were carried out using such a hot shoe. The apparatus used was as shown in the drawing and described in Example I except that heated roll assembly 21 was replaced by a hot shoe assembly. The hot shoe assembly consisted of: a double-sided curved metal shoe, heated with a Calrod TM heater, located between two change of direction rolls, one of which was canted relative to the other to provide wrap separation when using a multi-wrap stringup.

In each of Runs 18 and 19, the relative viscosity of the as spun yarn was 51.4 and the yarn wound up on the package was an approximately 22 dtex, 7 filament, false twist textured nylon 6,6 yarn which was textured at a speed of 1500 meters/minute.

In Run 18 roll assembly 18 was operated at a peripheral speed of 362.6 meters/minute. The yarn was passed around the hot shoe assembly for 1½ wraps. The hot shoe was operated at a surface temperature of 62° C. Draw roll assembly 24 was operated at a peripheral speed of 1200 meters/minute to partially draw the yarn at a draw ratio of 1200/362.6=3.31.

In the draw-texturing zone, heater plate 29 was operated at a temperature of 220° C.; and friction twisting element 32 was operated at 22,331 revolutions/minute. Draw roll assembly 33 was operated at a peripheral speed of 1500 meters/minute to draw the partially drawn yarn at a draw ratio of 1500/1200=1.25. The overall draw ratio (in the hot drawing zone plus the draw texturing zone) was 1500/363.6=4.14. The textured yarn was wound up on package 42.

In Run 19, the following conditions were different from those of Run 16. Roll assembly 18 was operated at a peripheral speed of 382.2 meters/minute. The yarn was wrapped around the hot shoe assembly for 2½ wraps. The hot shoe was operated at a surface temperature of 72° C. Draw roll assembly 24 was operated at a peripheral speed of 1111 meters/minute to partially draw the yarn at a draw ratio of 1111/382.2=2.91.

In the draw texturing zone, friction twisting element 32 was operated at 22,357 revolutions/minute. Draw roll assembly 33 was operated at a peripheral speed of 1500 meters/minute to draw the partially drawn yarn at a draw ratio of 1500/1111=1.35. The overall draw ratio (in the hot drawing zone plus the draw-texturing zone) was 1500/382.2=3.92.

FAK uniformity ratings were obtained by the method described hereinbefore for the textured yarn produced in each of Runs 18 and 19. The FAK uniformity rating for each of Runs 18 and 19 are tabulated below in TABLE 4.

TABLE 4

| Run No. | Surface Temperature of Hot Shoe (°C.) | FAK Uniformity |
|---|---|---|
| 18 | 62 | 8 |
| 19 | 72 | 8 |

It may be observed from a comparison of TABLE 4 with TABLE 3 of Example III, that the FAK uniformity rating of textured yarn produced using a hot shoe in the hot drawing step is similar to the FAK uniformity rating of textured yarn produced using a heated feed roll at about the same surface temperature.

I claim:

1. A continuous spin-draw-false twist texturing process for producing a textured nylon yarn having high yarn uniformity, the process comprising the steps of:

(a) melt spinning a plurality of nylon filaments from nylon polymer;

(b) cooling the filaments and combining them to form a yarn;

(c) controlling the processing conditions of the nylon polymer of step (a) such that the relative viscosity of the yarn formed in step (b) is at least 45;

(d) partially drawing the yarn at a draw ratio of from 2.3 to 3.5 and at a temperature of at least 50° C.;

(e) simultaneously false twist texturing and further drawing the partially drawn yarn in a draw-false twist texturing zone at a draw ratio of from 1.1 to 1.5; and (f) withdrawing the textured nylon yarn at a speed of at least 1500 meters per minute.

2. The process according to claim 1 wherein the processing conditions of the nylon polymer of step (a) are controlled such that the relative viscosity of the yarn formed in step (b) is in the range of from 45 to 75.

3. The process according to claim 2 wherein the step of partially drawing the yarn is carried out by passing the undrawn yarn in a plurality of wraps around a heated feed roll and from the feed roll to a draw roll which is operating at a higher peripheral speed than the peripheral speed of the feed roll, the feed roll being operated at a temperature in the range of from 50° C. to 75° C.

4. The process according to claim 3 wherein the textured nylon yarn is withdrawn at a speed in the range of from 1500 to 2400 meters/minute.

5. The process according to claim 4 wherein the textured nylon yarn is withdrawn at a speed in the range of from 1500 to 2200 meters/minute.

6. The process according to claim 5 wherein the nylon polymer is nylon 6,6 polymer.

7. The process according to claim 5 wherein the nylon polymer is nylon 6 polymer.

8. The process according to claim 5 wherein the nylon polymer is a nylon 66/6 copolymer.

9. The process according to claim 4 wherein a tension in the range of from 0.4 to 0.8 dN/tex is imparted to the undrawn yarn before it is passed around the heated feed roll.

10. The process according to claim 9 wherein the yarn is partially drawn at a draw ratio of from 2.5 to 3.4 and wherein the draw ratio in the draw-false twist texturing zone is in the range of from 1.15 to 1.3.

11. The process according to claim 10 wherein the processing conditions of the nylon polymer of step (a) are controlled such that the relative viscosity of the yarn formed in step (b) is in the range of from 50 to 75.

12. The process according to claim 10 wherein the nylon polymer is nylon 6,6 polymer.

13. The process according to claim 10 wherein the nylon polymer is nylon 6 polymer.

14. The process according to claim 10 wherein the nylon polymer is a nylon 66/6 copolymer.

15. The process according to claim 1 wherein the nylon polymer is nylon 6,6 polymer.

16. The process according to claim 1 wherein the nylon polymer is nylon 6 polymer.

17. The process according to claim 1 wherein the nylon polymer is a nylon 66/6 copolymer.

* * * * *